US007209546B1

(12) United States Patent
Arnold et al.

(10) Patent No.: US 7,209,546 B1
(45) Date of Patent: Apr. 24, 2007

(54) APPARATUS AND METHOD FOR APPLYING AN ABSORPTIVE COATING TO AN X-RAY TUBE

(75) Inventors: Derrick G. Arnold, Salt Lake City, UT (US); Joshua N. Brown, West Jordan, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 180 days.

(21) Appl. No.: 10/122,567

(22) Filed: Apr. 15, 2002

(51) Int. Cl.
*H01J 35/10* (2006.01)

(52) U.S. Cl. ..... 378/142; 378/141

(58) Field of Classification Search ..... 378/119, 378/121, 141, 142, 127, 128, 129, 139, 140
See application file for complete search history.

(56) References Cited

U.S. PATENT DOCUMENTS

| | | | |
|---|---|---|---|
| 2,986,533 | A | 5/1961 | Kurtz |
| 4,090,103 | A | 5/1978 | Machenschalk et al. |
| 4,104,532 | A | 8/1978 | Weiss |
| 4,184,097 | A | 1/1980 | Auge |
| 4,468,802 | A | 8/1984 | Friedel |
| 4,619,963 | A | 10/1986 | Shoji et al. |
| 4,686,417 | A | 8/1987 | Noji |
| 4,744,944 | A | 5/1988 | Spencer et al. |
| 4,768,365 | A | 9/1988 | Spencer et al. |
| 4,841,557 | A | 6/1989 | Haberrecker et al. |
| 4,884,292 | A | 11/1989 | Klostermann |
| 4,928,296 | A | 5/1990 | Kadambi |
| 4,964,148 | A | 10/1990 | Klostermann et al. |
| 5,056,126 | A | 10/1991 | Klostermann et al. |
| 5,604,784 | A | 2/1997 | Widlicka et al. |
| 5,802,140 | A | 9/1998 | Virshup et al. |
| 5,814,824 | A | 9/1998 | Hamby et al. |
| 5,863,492 | A | 1/1999 | Bose |
| 6,045,601 | A | 4/2000 | Tan |
| 6,062,731 | A | 5/2000 | Guzik |
| 6,134,299 | A | 10/2000 | Artig |
| 6,153,666 | A | 11/2000 | Lagace |
| 6,215,852 | B1 | 4/2001 | Rogers et al. |
| 6,252,933 | B1 | 6/2001 | Artig |

*Primary Examiner*—Edward J. Glick
*Assistant Examiner*—Chih-Cheng Glen Kao
(74) *Attorney, Agent, or Firm*—Workman Nydegger

(57) ABSTRACT

An apparatus and method for applying an absorptive coating to a portion of the evacuated enclosure in an x-ray generating device is disclosed. The absorptive coating is applied to the inner surface of the evacuated enclosure to enhance its heat dissipation characteristics, which in turn assists in tube cooling during x-ray production. The absorptive coating is applied atop an intermediate bonding layer. Both the absorptive coating and the intermediate bonding layer are applied to the evacuated enclosure surface by electroplating processes. A plating apparatus comprising the evacuated enclosure portion, a plating fixture, and a base plate is used both to contain the electroplating solution during the plating process, as well as to facilitate its entry into and removal from the evacuated enclosure. A method of employing the plating apparatus to apply the intermediate bonding layer and the absorptive coating is also disclosed.

20 Claims, 4 Drawing Sheets

APPARATUS AND METHOD FOR APPLYING AN ABSORPTIVE COATING TO AN X-RAY TUBE

BACKGROUND OF THE INVENTION

1. The Field of the Invention

The present invention generally relates to x-ray tube devices. In particular, the present invention relates to coatings, and coating procedures, that can be used in the manufacture of x-ray tube components.

2. The Related Technology

X-ray producing devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impinged upon a material of a particular composition. This process typically takes place within an evacuated enclosure of an x-ray tube.

The evacuated enclosure portion of an x-ray tube can be implemented in any one of a number of ways. For example, one common implementation includes one portion that is formed of a heat-conductive material, such as copper. A second portion comprises a glass or ceramic material. The two portions are then hermetically sealed together so as to maintain a vacuum within the resulting enclosure (sometimes referred to as the "can").

Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by ball bearings contained in a bearing assembly.

In operation, an electric current is supplied to a filament portion of the cathode, which causes a stream of electrons to be emitted via a process known as thermionic emission. A high voltage potential is placed between the cathode and anode to cause the electrons to form a stream and accelerate towards a target surface located on the anode. Upon striking the target surface, some of the resulting kinetic energy is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The x-rays are then collimated so that they exit the x-ray tube through a window in the tube, and enter the x-ray subject, such as a medical patient.

As discussed above, some of the kinetic energy resulting from the collision with the target surface results in the production of x-rays. However, much of the kinetic energy is released in the form of heat. Still other electrons simply rebound from the target surface and strike other "non-target" surfaces within the x-ray tube. These are often referred to as "backscatter" electrons. These backscatter electrons retain a significant amount of kinetic energy after rebounding, and when they also impact other non-target surfaces they generate large amounts of heat.

Heat generated from these target and non-target electron interactions can reach extremely high temperatures and must be reliably and continuously removed. If left unchecked, it can ultimately damage the x-ray tube and shorten its operational life. Some x-ray tube components, like ball bearings housed in the bearing assembly, are especially sensitive to heat and are easily damaged. For instance, high temperatures can melt the thin metal lubricant that is typically present on the ball bearings, exposing them to excessive friction. Additionally, repeated exposure to these high temperatures can degrade the bearings, thereby reducing their useful life as well as that of the x-ray tube.

These problems related to high temperatures produced in the x-ray tube have been addressed in a variety of ways. For example, rotating anodes are used to effectively distribute heat. The circular face of a rotating anode that is directly opposed to the cathode is called the anode target surface. The focal track comprising a high-Z material is formed on the target surface. During operation, the anode and rotor shaft supporting the anode are spun at high speeds, thereby causing successive portions of the focal track to continuously rotate in and out of the electron beam emitted by the cathode. The heating caused by the impinging electrons is thus spread out over a larger area of the target surface and the underlying anode.

While the use of the rotating anode is effective in reducing the amount of heat present on the anode, high levels of heat are still typically present. Thus, cooling structures are often employed to further absorb and dissipate additional heat from the anode. Once absorbed, the heat is typically conveyed to the evacuated enclosure surface, where it is then absorbed by a circulated coolant. One example of such an arrangement utilizes cooling fins that are placed adjacent to the anode. During tube operation heat is transferred from the anode to the evacuated enclosure surface via the cooling fins and then absorbed by the circulating coolant.

Another attempt to dissipate heat in x-ray tubes involves the use of more massive anode structures, enabling a given amount of conducted heat to be spread throughout a larger volume than that available in smaller anodes. Unfortunately, larger anodes require correspondingly more massive rotor assemblies to support the increased mass and rotational inertia of the anode. This in turn creates a larger conductive heat path from the anode, through the rotor shaft, and into the bearings in the rotor assembly, thus causing unwanted bearing heating.

The above cooling practices, while effective for general heat removal, can be insufficient by themselves to prevent heat from passing from the anode, through the rotor shaft, and into the bearings and other areas of the tube—especially in today's higher power x-ray tubes. As discussed before, this heat is highly detrimental to the bearings, and to other components within the x-ray tube.

Another method to reduce the effects is of high operating temperatures is to provide x-ray tube components with coatings that exhibit improved thermal characteristics. For instance, emissive coatings have been applied to various anode surfaces to enhance the rate of heat transferred from the anode. Additionally, an absorptive coating may be disposed, for example, on the inside surface of the evacuated enclosure to enhance the absorption by the enclosure of heat emitted by the anode, and the subsequent transfer of that heat to the can exterior where it may be removed by the circulated coolant. This absorptive coating has typically comprised a thin layer of iron that is mechanically bonded to the inner surface of the evacuated enclosure or housing.

The use of such coatings has not been completely successful however. For instance, over time the repeated cycles of heating and cooling may cause absorptive coatings to flake or spall away from the coated surface. This debris can then contaminate other components within the x-ray tube, and lead to its premature failure. Moreover, there is often a thermal mismatch between the surface of the coated component and the absorptive coating, which tends to weaken the bond between the two materials as they thermally expand during use. Again, this leads to undesired flaking and spalling and the consequent contamination of the x-ray tube.

The flaking and spalling described above may also cause electrical arcing within the evacuated x-ray tube, which may result in severe electrical damage to a number of x-ray tube components and/or failure of the x-ray device.

Many of the above problems associated with flaking and spalling are exacerbated when the coating is mechanically bonded to the x-ray tube component. For example, an absorptive coating comprising an iron plating may be mechanically bonded to a surface of an evacuated can comprising copper by immersing the can in a bath comprising iron solution. Such a mechanical bond existing between an absorptive coating and the inner surface of the evacuated can is a relatively low-strength bond. The relative weakness of the mechanical bond may cause the absorptive layer to flake away when the can is subjected to relatively small amounts of thermal or mechanical stress.

The above situation is made worse when mechanically bonded coatings are employed in high-power x-ray tubes. These high-power x-ray tubes are capable of higher operating temperatures and longer operation times than standard x-ray tubes. This, in turn, results in increased mechanical and thermal stress on tube components, including the rotating anode and the evacuated can enclosure. This increased stress serves only to increase the incidence of flaking or spalling of the absorptive coatings, especially those that are applied to the inner surface of the evacuated can.

Another drawback encountered with coatings that are mechanically bonded to the evacuated can relates to the preparation work required to apply the coating. For example, before mechanically bonding an absorptive coating to the inner surface of the evacuated can, grit blasting of the can surface is often necessary in order to prepare the surface for adhesion of the coating. In grit blasting, the surface to be treated is blasted with high velocity, irregularly sized bits of metal, such as aluminum dioxide or other suitable material, in order to give it a roughened surface that enhances the adhesion of the iron to the can surface. While effective at preparing the can surface, grit blasting may also temporarily embed grits into the can surface. Later, during operation of the x-ray tube, grit particles may work free from the inner can surface and contaminate the volume of the evacuated tube. These particles pose a contamination and/or electrical arcing risk similar to the risk posed by the flaking of the absorptive coating, as described above.

Another drawback related to the mechanical bonding of the absorptive coating to the evacuated can relates to the fact that less control is achieved as to where the absorptive coating is applied to the inner surface of the can. Thus, a technician is prevented from precisely controlling application of the absorptive coating, which results in increased cost and waste during tube manufacture.

What is needed, therefore, is an x-ray tube that withstands the destructive heat produced within it during use, thus protecting its components. Also desired is a method which more efficiently dissipates heat produced by the anode to the evacuated enclosure and away from heat sensitive tube components. Further, a method for applying absorptive or other coatings to the surface of the evacuated enclosure, such that flaking or spalling is reduced or eliminated, is also needed. Also, any solution to the above should enable greater control to be exercised as to where the absorptive coating is applied to the evacuated enclosure.

BRIEF SUMMARY OF THE INVENTION

The present invention has been developed in response to the above and other needs in the art. Briefly summarized, embodiments of the present invention are directed to an apparatus and method for applying an absorptive coating to portions of an evacuated enclosure of an x-ray tube. However, while preferred embodiments relate to the application of a coating to the evacuated enclosure, it will be appreciated that other tube components may also be coated so as to improve thermal characteristics.

An evacuated enclosure or can made in accordance with embodiments of the present invention features an intermediate bonding layer that is electroplated to at least a portion of the inner surface of the can. An absorptive coating layer is then applied via electroplating atop the intermediate bonding layer. This absorptive coating layer serves to improve heat transfer from the inner surface of the evacuated can to the outer surface, where the heat may be dissipated by circulated coolant, for example. The intermediate bonding layer functions to strengthen the adhesion of the absorptive coating layer to the inner surface of the evacuated can. In preferred embodiments, both the intermediate bonding layer and the absorptive coating are characterized by the fact that they form a chemical bond with the respective surface to which they are adhered. Thus, the intermediate bonding layer is chemically bonded to the inner surface of the evacuated can, while the absorptive coating is chemically bonded to the intermediate layer. These chemical, or intermetallic, bonds allow the intermediate bonding layer and absorptive coating to have increased thermal and mechanical stability such that flaking and spalling of the coatings from the surface of the can are significantly reduced. This, in turn, enables the evacuated environment of the vacuum enclosure to be free from contaminating particles, which may prove detrimental to the operation of the x-ray tube, and which may severely reduce its operational life.

Embodiments of the present invention preclude the need for mechanically bonding an absorptive coating to the inner surface of the evacuated can. This, in turn, eliminates the need for grit blasting the evacuated can prior to application of the absorptive coating. The elimination of grit blasting removes another potential source of particle contamination to the vacuum enclosure by eliminating the possibility of inadvertent release of embedded grit particles from the inner surface of the evacuated can.

The absorptive coating applied using the method disclosed by embodiments of the present invention is also better able to withstand the higher operating temperatures and thermal stress conditions that are present in high-power x-ray devices. This feature enables evacuated cans having the absorptive coating to find equal application in both high power and standard x-ray devices.

Embodiments of the present invention also disclose a plating apparatus that is used in electroplating the intermediate bonding layer and absorptive coating to the evacuated can. In general, the plating apparatus comprises the evacuated can itself, which serves as both the containment vessel for solutions utilized in the electroplating process and as the cathode in that process. The plating apparatus also comprises a plating fixture that is disposed within the evacuated can during the electroplating process and that serves as the anode for that process.

Embodiments of the present invention also disclose a method by which the plating apparatus is utilized in applying the intermediate and absorptive coatings to the evacuated can. In particular, a liquid solution electroplating process is utilized in applying these coatings to the can surface. Generally speaking, various solutions are continuously pumped in turn into the can via a fluid inlet. The plating fixture, disposed within the can, maintains the level of the solution within the can by providing an excess fluid outlet at the top of the fixture. The continuous pumping of the respective electroplating solution into the inner volume of the can, together with the corresponding removal of excess solution from the can via the excess fluid outlet of the plating fixture, not only maintains the solution at a desired level within the can, but also ensures continuous mixing of the solution, as well as constant replenishment thereof, to yield superior electroplating results.

Thus, in accordance with one embodiment of the present method, the first of two plating solutions is first injected via the fluid inlet into the can inner volume during the manufacturing process of the x-ray tube. The solution is continuously pumped into the can until the solution reaches the top of the plating fixture. At that point, the continuously pumped solution begins to cascade into the excess fluid outlet in a weir-like fashion, such that the solution passes through the interior of the plating fixture and exits the can via the other end of the fixture. Thus, the level of plating solution in the inner volume of the can is maintained at a specified level, which corresponds to the height of the plating fixture as disposed within the can inner volume. Utilizing electroplating techniques, the first plating solution forms an intermediate bonding layer on the inner surface of the can.

After the intermediate bonding layer has been formed, the first plating solution is emptied from the inner volume of the can, and a second plating solution is pumped into the can. The above process is repeated to form an absorptive coating atop the intermediate bonding layer. Intermediate washing steps are also performed before, after, and between these plating steps. In this way, a stable absorptive coating is applied to the inner surface of the evacuated can, which is then joined to other evacuated enclosure portions to form the evacuated enclosure of the x-ray tube.

By virtue of the constant solution level that is maintained within the inner volume of the can by virtue of the plating fixture, more precision and control is offered the manufacturer in applying the absorptive coating to the can surface. That is, the manufacturer is able to plate a pre-determined area of the inner surface of the evacuated can simply by specifying the height of the plating fixture as disposed within the can volume. This, in turn, results in more efficiency and less waste in the tube manufacturing process.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

FIGS. 1–6 depict various features of embodiments of the present invention, which is generally directed to the application of an absorptive coating upon the inner surface of an evacuated enclosure (also referred to herein as the "can") portion of an x-ray generating device. The absorptive coating is chemically bonded via electroplating processes to an intermediate bonding layer, which in turn is chemically bonded via electroplating to the inner surface of the evacuated can. The chemical nature of the bond of the intermediate and absorptive coatings on the evacuated can allow them to possess characteristics that prevent the absorptive coating from degrading and flaking during use of the x-ray device. The chemical bonding of the absorptive coating provides an alternative to traditional mechanical bonding of the layer to the evacuated can, which is known to provide a less stable bond and which may allow flaking and spalling of the absorptive coating to occur. Thus, the use of the chemically bonded absorptive coating is directed toward the goals of extending the operational life of the x-ray tube and its components by avoiding the problems associated with flaking and spalling while providing enhanced heat dissipation characteristics for the evacuated can. A plating apparatus and method employed to provide the intermediate bonding layer and absorptive coating on the evacuated can is also disclosed.

Figure 1:
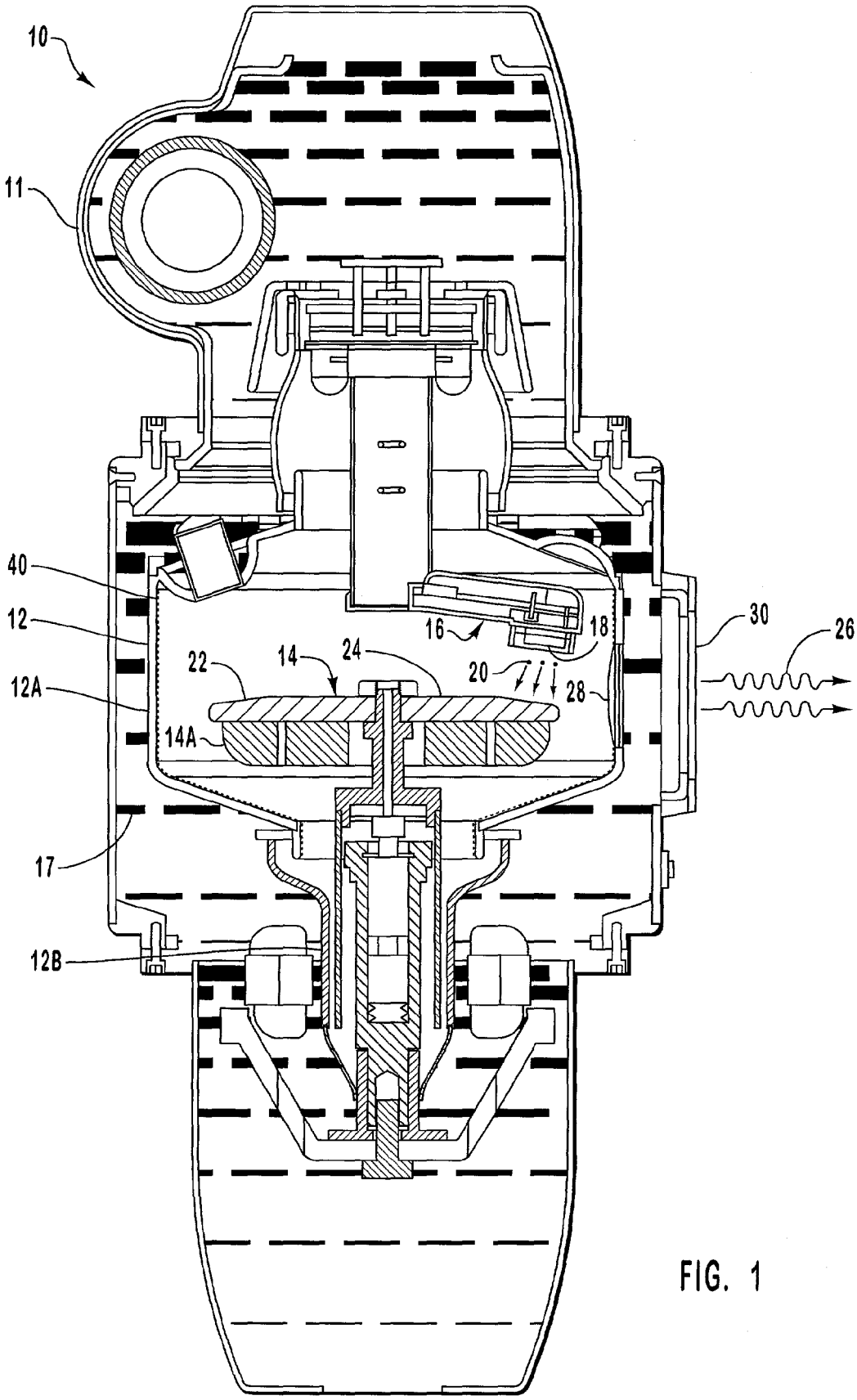
FIG. 1 is a cross-sectional view of a rotating anode x-ray tube, including an evacuated can manufactured in accordance with one embodiment of the claimed invention.

Reference is first made to FIG. 1, which illustrates a simplified structure of a conventional rotating anode-type x-ray tube, designated generally at 10, as fully assembled. X-ray tube 10 includes an outer housing 11 enclosing an evacuated enclosure 12. The evacuated enclosure 12 has disposed therein a rotating anode 14 and a cathode 16. A coolant 17 commonly envelops and circulates within the outer housing 11 and around the evacuated enclosure 12 to assist in tube cooling. Anode 14 is spaced apart from and oppositely disposed to cathode 16. Anode 14 is typically composed of a thermally conductive material such as copper or a molybdenum alloy. Anode 14 may also comprise an additional portion 14A composed of graphite to assist in dissipating heat from the anode. As is well known, cathode 16 includes a filament 18 that is connected to an appropriate power source. The anode 14 and cathode 16 are connected within an electrical circuit that allows for the application of a high voltage potential between the anode and the cathode. An electrical current passed through the filament 18 causes a stream of electrons, designated at 20, to be emitted from the cathode 16 by thermionic emission. The high voltage differential between the anode 14 and the cathode 16 then causes electrons 20 to accelerate from cathode filament 18 toward a focal track 22 that is positioned on a target surface 24 of rotating anode 14. The focal track 22 is typically composed of tungsten or a similar material having a high atomic ("high Z") number. As the electrons 20 accelerate, they gain a substantial amount of kinetic energy. Upon approaching and interacting with the target material on the focal track 22, some of the electrons 20 convert their kinetic energy and either emit or cause to be emitted from the focal track material electromagnetic waves of very high frequency, i.e., x-rays. The resulting x-rays, designated at 26, emanate from the anode target surface 24 and are then collimated through windows 28 and 30 defined in the evacuated enclosure 12 and outer housing 11, respectively, for penetration into an object, such as an area of a patient's body. As is well known, the x-rays that pass through the object can be detected and analyzed so as to be used in any one of a number of applications, such as x-ray medical diagnostic examination or materials analysis procedures.

Figure 2:
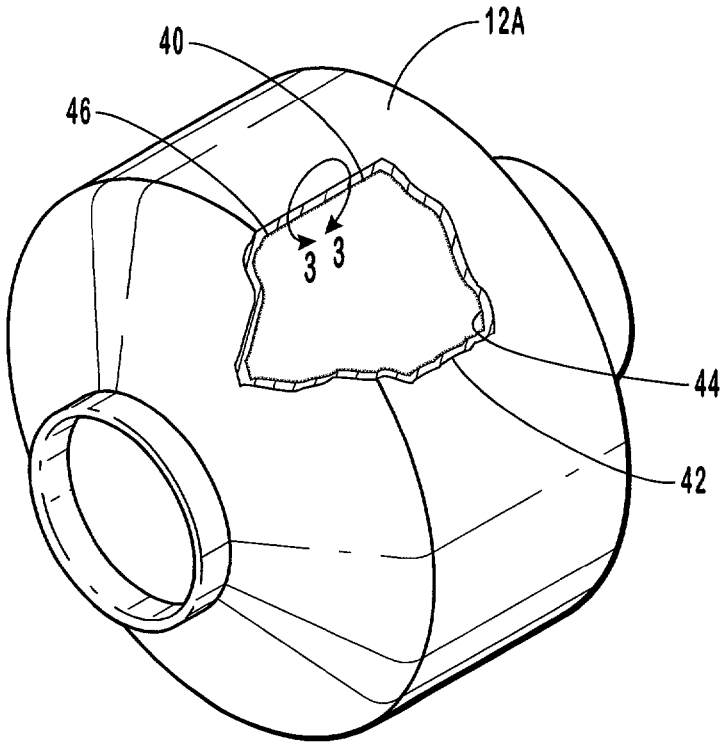
FIG. 2 is a perspective cutaway view of the evacuated can shown in FIG. 1, showing intermediate bonding and absorptive coatings disposed on the inner surface of the can in accordance with one embodiment of the present invention.

With continuing reference to FIG. 1 and additional reference to FIG. 2, additional detail is disclosed pertaining to the evacuated enclosure 12. In one embodiment, the evacuated enclosure 12 comprises a first can portion 12A, and a second portion 12B. The two portions 12A and 12B are hermetically joined so as to be able to maintain a vacuum therein. As is well known in the art, both the anode 14 and the cathode 16 are disposed within the vacuum environment created by the evacuated enclosure 12. The can portion 12A of the evacuated enclosure 12 typically comprises a thermally conductive material, such as copper, while the second portion 12B may comprise glass, ceramic, or other appropriate material. In other embodiments, the evacuated enclosure 12 can be constructed entirely of a single material, such as copper.

In one presently preferred embodiment, an absorptive coating 40 is disposed on at least a portion of an inner surface 42 of the can portion 12A. As will be explained in greater detail below, the absorptive coating 40 is applied in such a manner and in accordance with the present invention as to increase absorption by the can portion 12A of heat emitted by the anode 14 during the operation. As is well known, this heat may then be transmitted to the outer surface of the can portion 12A, where it is then typically dissipated by the coolant 17 circulating within the outer housing 11. As already explained, the absorptive coating 40 is characterized by its high thermal and mechanical stability, in addition to its thermal absorptive capabilities, thereby improving the thermal characteristics of the x-ray tube, while reducing the likelihood of flaking and spalling of the coating.

Figure 3:
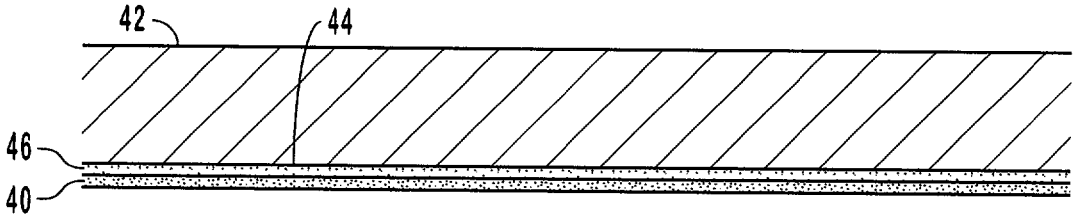
FIG. 3 is a close-up, cross-sectional view of a portion of the evacuated can of FIG. 2, showing an intermediate bonding and absorptive coatings in greater detail.

Reference is now made to FIGS. 2 and 3, wherein further details concerning the absorptive coating 40 are disclosed. Both figures show cross-sectional views of the wall of the can portion 12A, which comprises a portion of the evacuated enclosure 12. The wall of the can portion 12A is referred to herein as substrate 42. In the illustrated embodiment, the substrate 42 comprises copper, as previously mentioned. An inner surface 44 of the substrate 42 of can portion 12A has disposed thereon the absorptive coating 40. As can be seen from FIG. 3, which is a close-up, cross-sectional view of a portion of the can wall seen in FIG. 2, the absorptive coating 40 is disposed proximate the inner surface 44 of the can portion 12A. The inner surface 44 is defined as that portion of the can portion 12A that is in direct contact with the vacuum maintained by the evacuated enclosure 12 as fully assembled. As alluded to above, the absorptive coating 40 is disposed proximate the inner surface 44 so as to enhance the absorption by the substrate 42 of heat emitted by the anode 14 during operation of the x-ray tube 10. Also, as discussed above, the heat absorbed by the absorptive coating 40 is preferably transmitted through the substrate 42 and dissipated on the outer surface of the can portion 12A so as to assist in heat removal from the x-ray tube 10.

As can be seen from FIG. 3, absorptive coating 40 is adhered to the substrate 42 of the can portion 12A via an intermediate bonding layer 46. The intermediate bonding layer 46 forms an intermetallic chemical bond between itself and the substrate 42, and between itself and the absorptive coating 40. These chemical bonds enable both the intermediate bonding layer 46 and the absorptive coating 40 to securely adhere to the inner surface 44 of the substrate 42. This, in turn, provides a stable absorptive coating 40 that will not flake or spall during tube operation, thereby avoiding contamination of the evacuated enclosure 12. Both the intermediate bonding layer 46 and the absorptive coating 40 are preferably applied by an electroplating process, the steps of which are set forth further below.

In a presently preferred embodiment, the intermediate bonding layer 46 comprises nickel. Nickel is a preferred material here because it readily forms intermetallic bonds with both copper, from which the can portion 12A is preferably made, and iron, which preferably comprises the absorptive coating 40, as discussed below. However, it is appreciated that other materials may be used that are capable of forming intermetallic bonds both with the can portion 12A and the absorption coating 40, and that possess a similar coefficient of thermal expansion to that of the substrate 42 and the absorptive coating 40, as may be appreciated by one of skill in the art.

In a presently preferred embodiment, the absorptive coating 40 comprises iron by virtue of its thermal absorption qualities. Generally speaking, the absorptive coating 40 should possess certain characteristics. First, it should provide a high thermal absorptivity. Second, the absorptive coating 40 should possess an intermetallic bonding affinity for the material to be adhered to. Preferably, the absorptive coating 40 also possesses a similar coefficient of thermal expansion to that of the substrate 42 and the intermediate bonding layer 46, such that flaking and spalling are further minimized. Finally, the absorptive coating 40 should exhibit good vacuum properties. This ensures that the coating material will not outgas or otherwise break down under high vacuum, high temperature conditions that exist inside the x-ray tube 10 during operation. Alternative materials that could also be utilized as the absorptive coating 40 include, but are not limited to, chrome oxide, titanium, and titanium dioxide.

As seen in FIG. 1, the absorptive coating 40 is disposed on a substantial portion of the inner surface 44 of the can portion 12A. Both the intermediate bonding layer 46 and the absorptive coating 40 may be applied to all or a portion of the inner surface 44 of the can portion 12A, as may be desired for particular tube application.

It is appreciated that, though the can portion 12A is described herein as comprising copper, a broad range of metal compositions may alternatively be utilized in forming the can portion. Preferable materials from which the can portion 12A may be manufactured include steel, Kovar, copper alloys, and other materials that are capable of chemically bonding with the intermediate bonding layer 46, such an intermetallic bond may be created between the layer and the can portion 12A.

It is further appreciated that the can portion to which the intermediate bonding layer 46 and absorptive coating 40 are applied may comprise any one of a variety of shapes and configurations, in accordance with the particular application involved. Thus, the particular shape and other details disclosed herein regarding the can portion 12A are not to be considered limiting of the present invention in any way.

Figure 4:
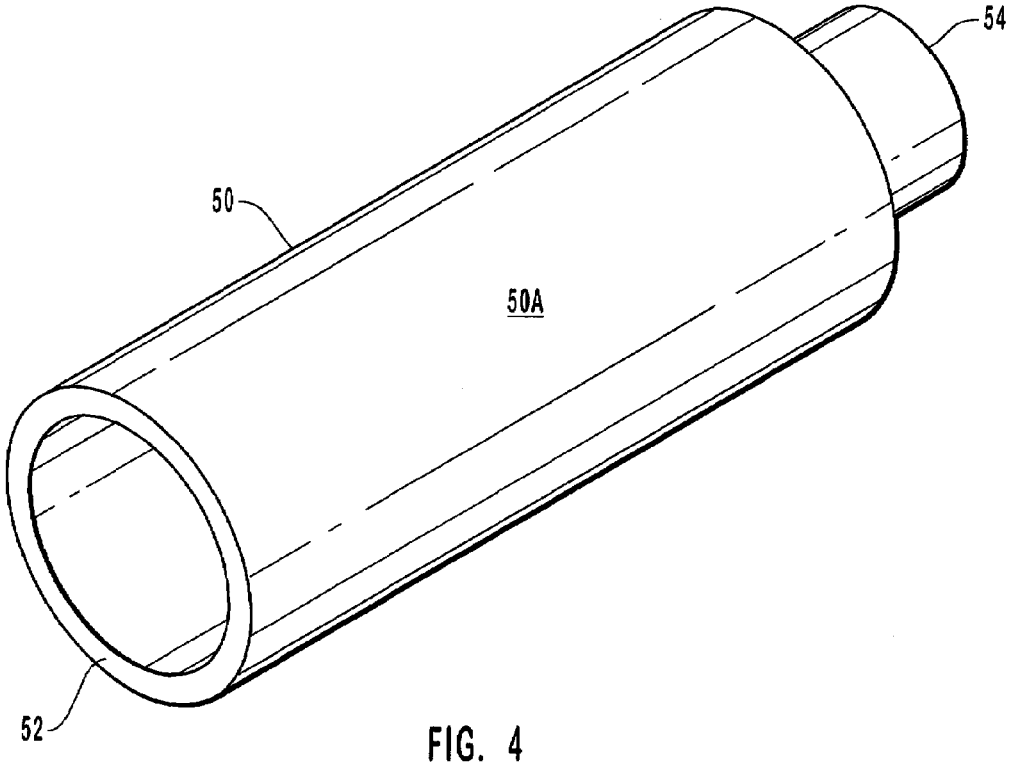
FIG. 4 is a perspective view of a plating fixture used in accordance with one embodiment of the present invention.

Reference is now made to FIG. 4, which illustrates a perspective view of a plating fixture 50 used in accordance with one embodiment of the present invention. In the presently preferred embodiment, the plating fixture 50 serves as an anode in an electroplating process by which the intermediate bonding layer 46 and absorptive coating 40 are applied to the inner surface 44 of the can portion 12A. Thus, the plating fixture 50 comprises a material that is suitable for an electroplating anode. In one embodiment, the plating fixture 50 comprises a platinum-titanium alloy. The plating fixture 50 could alternatively comprise titanium that is coated with platinum, or other appropriate material. As such, the plating fixture 50 does not dissolve as some electroplating anodes do, but rather remains integral during the electroplating process as is described further below.

Figure 5:
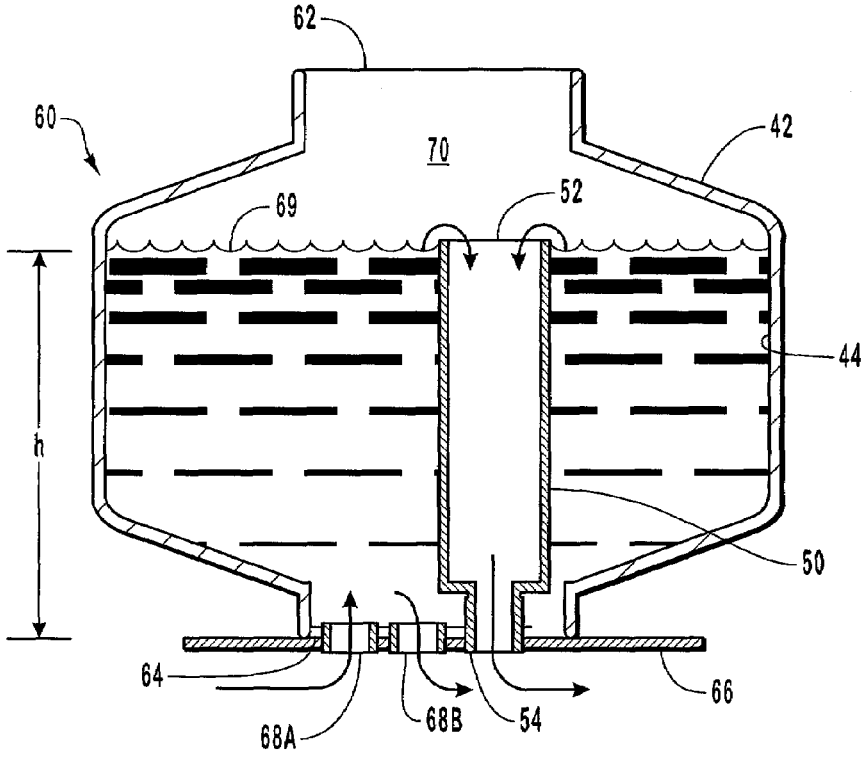
FIG. 5 is a cross-sectional view of an evacuated can having disposed therein a plating solution in accordance with one embodiment of the present method for applying the absorptive coating.

As can be seen from FIGS. 4 and 5, the plating fixture 50, according to one presently preferred embodiment, comprises a hollow body 50A having open first and second ends 52 and 54, respectively. The construction of the plating fixture 50 is such that the first end 52 is in fluid communication with the second end 54 via the hollow body 50A. The function of the plating fixture 50 in the electroplating process will be described further below. It is appreciated that variations to the length, size, and/or configuration of the plating fixture 50 may be had while still residing within the claims of the present invention. Thus, the details concerning the plating fixture 50 as given in the descriptions of the present invention herein are not meant to be limiting of the present invention.

Reference is now made to FIG. 5, which shows the plating fixture 50 disposed in a plating apparatus, generally indicated at 60, according to one embodiment of the present invention. The plating apparatus 60 is used to apply both the intermediate bonding layer 46 and the absorptive coating 40 to the inner surface 44 of the can portion 12A. Electroplating techniques are employed in conjunction with the plating apparatus 60 in depositing the aforementioned coatings such that the coatings form stable, high-strength chemical bonds with the inner surface 44 of the can portion 12A. According to one presently preferred embodiment, the plating apparatus 60 generally comprises the can portion 12A having first and second ends 62 and 64, respectively, the plating fixture 50, and a base plate 66 including a fluid inlet 68A and a fluid outlet 68B. It is noted here that the discussion to follow will concentrate on various details of the aforementioned components of the plating apparatus 60. However, it should be appreciated that various other configurations may be possible regarding the components that comprise the plating apparatus 60. Thus, modifications to these components that preserve the functionality as described herein are appreciated as residing within the scope of the present invention.

The can portion 12A serves as the cathode in the electroplating process, as will be discussed. The can portion 12A also serves as the vessel in which the solutions that are employed in the electroplating process are contained. Again, it is appreciated that the can portion 12A may comprise more or less of the evacuated enclosure 12 than what is shown in FIG. 5. It is sufficient that the can portion used as a component of the plating apparatus 60 be configured so as to be able to contain an electroplating solution, and to house the plating fixture 50, as described above.

The various solutions that are used in the electroplating process may be input into an inner volume 70 of the can portion 12A via the fluid inlet 68A. Likewise, the solutions may be discharged from the inner volume 70 via the fluid outlet 68B. The fluid inlet 68A and the fluid outlet 68B are preferably defined in the base plate 66, though various other configurations may be conceived for providing fluid communication with the inner volume 70. The base plate 66 forms a fluid-tight seal with the second end 64 of the can portion 12A so as to prevent the escape of solution therethrough. It is noted that the base plate 66 may comprise various other shapes and configurations as may be appreciated by one skilled in the art. The aperture in the can portion 12A where the window 28 will be disposed may also be sealed in a fluid-tight arrangement.

In the illustrated embodiments, a means for maintaining a pre-determined amount of fluid in the can portion 12A is provided by the plating fixture 50. Specifically, first and second ends 52 and 54 of the plating fixture 50 provide the means by which the amount of the inner volume 70 is maintained during the electroplating process. As can be seen from FIG. 5, the inner volume 70 is continuously filled with an electroplating solution 69 via the fluid inlet 68A. The electroplating solution 69 may comprise a plating fluid or rinsing solution, or any other fluid used in the electroplating process discussed further below. Once the respective electroplating solution 69 has reached a level in the inner volume 70 that corresponds to the top of the plating fixture 50, the solution begins to cascade in a weir-like fashion over the first end 52 and into the hollow body 50A of the plating fixture. The solution then passes through the plating fixture 50 and exits the fixture via the second end 54. The electroplating solution 69 may then be recirculated into the inner volume 70, or collected in a holding tank (not shown). This level-maintaining function only occurs when the level of the electroplating solution 69 exceeds a height "h," corresponding to the height of the plating fixture 50, as seen in FIG. 5. Thus, it is seen that the plating fixture 50 is an important component in precisely maintaining a predetermined amount of the electroplating solution 69 within the inner volume 70 of the can portion 12A. In this way, the area of the inner surface 44 to be coated may be precisely controlled simply by varying the height of the plating fixture 50 as disposed in the inner volume 70 of the can portion 12A. In the illustrated embodiment, for instance, it is seen that the plating fixture 50 has a height "h" sufficient to allow the electroplating solution 69 used in the electroplating process to rise to a level that is near the top of the can portion 12A. Thus, the surface area portion of the inner surface 44 that will be coated by the intermediate bonding layer 46 and the absorptive coating 40 corresponds to the height of the plating fixture 50.

The ability of the plating fixture 50 to maintain the electroplating solution 69 at a consistent level enables a superior electroplating process to be performed. The constant inflow of the electroplating solution 69 through the fluid inlet 68, in conjunction with the constant outflow of the solution through the plating fixture 50, maintains the electroplating solution 69 continuously stirred such that thermal stagnation and ion concentration imbalance in the solution is avoided. Further, the electroplating solution 69 is continuously refreshed with new solution flowing in from the fluid inlet 68. The constant mixing and regeneration of the electroplating solution 69 ultimately results in the superior chemical adhesion of both the intermediate bonding layer 46 and the absorptive coating 40. If desired, a mechanical mixer, fins, or other similar components (not shown) could be incorporated within the inner volume 70 to further intermix the respective electroplating solution 69.

As already discussed, during the electroplating process the plating fixture 50 serves as the electroplating anode, while the can portion 12A serves as the electroplating cathode. The operation of the anode and cathode are well known in the art of electroplating. To this end, both the plating fixture 50 and the can portion 12A are electrically connected to an appropriate power source so as to provide the needed electrical current for the electroplating process.

Figure 6:
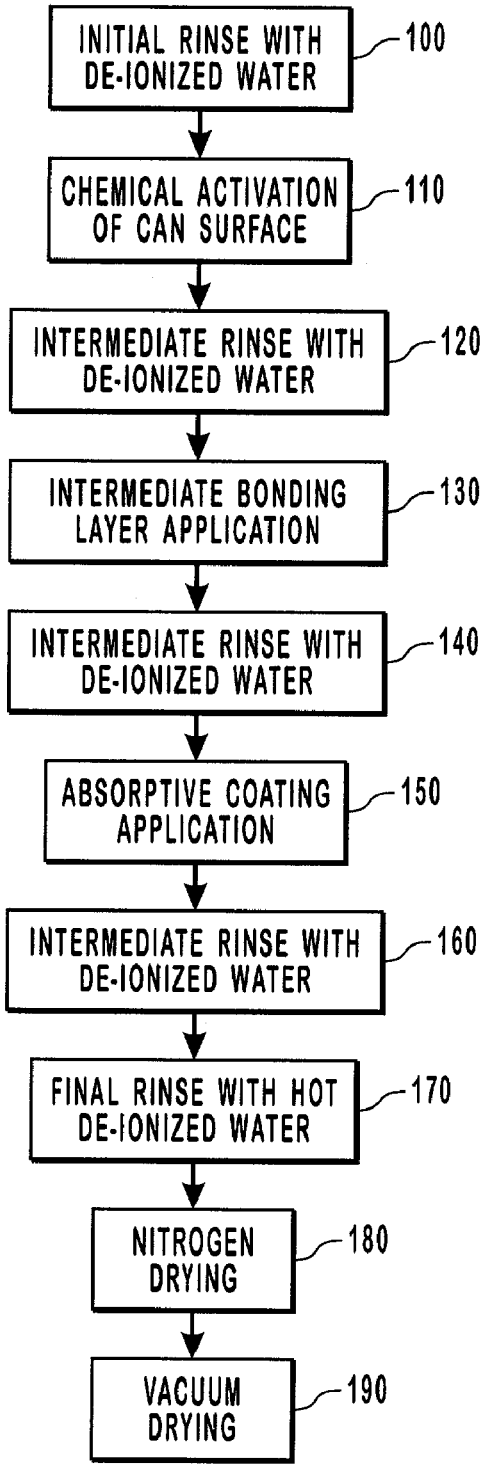
FIG. 6 is a flow chart representing various steps of one embodiment of the present method for applying the absorptive coating to the evacuated can.

Reference is now made to FIG. 6, which illustrates a flow chart describing various steps involved in applying both the intermediate bonding layer 46 and the absorptive coating 40 to the inner surface 44 of the can portion 12A according to one presently preferred embodiment. As already mentioned, the deposition of these coatings is performed by an electroplating process. Electroplating produces a metallic coating on a surface by means of electro-deposition, which is deposition by the action of an electric current. In a typical electroplating process, the article to be plated is first cleaned of any grease or dirt by washing it with an acid or other cleaning solution. The article to be plated is then placed in a solution comprising the metal with which the article will be plated. The metallic solution primarily comprises positive ions of the metal. A negative electrical source is connected to the article to be plated, which serves as the electroplating cathode. A positive electrical source is connected to an electroplating anode which is put into contact with the metallic solution. The electric current that flows between the anode and the cathode acts on the metallic ions in the solution and causes them to be attracted to the cathode (article), thereby causing an electroplating coating to be deposited on the surface of the article. Using this electroplating process, plating layers of various thicknesses may be applied to the article, according to the strength of the electric current, the metallic concentration of the solution, and the time that the article is kept in the solution. The present invention employs a similar process, as modified below, to deposit coatings on the can portion 12A.

As mentioned above, the strength of the electric current used in the electroplating process partially determines the thickness and quality of the layers applied to the article. Current density is one quantity by which the strength of the electric current may be determined. Current density is a measure of the amount of current flowing to or from a unit area of the electroplating anode or cathode, and is typically expressed in amperes ("amps") per square foot. In a presently preferred embodiment, the current density used to apply the intermediate bonding layer 46 and the absorptive coating 40 is preferably 20 amperes ("amps") per square foot, which equals approximately 0.139 amps per square inch. Thus, to determine the current strength for plating the can portion 12A, the surface area of the can portion 12A is multiplied by the required current density given above. For example, if the can portion 12A has an area to be plated that comprises 43 square inches, this figure is multiplied by 0.139 amps per square inch, thereby yielding a desired current strength for the electroplating process of approximately 6 amps.

Various steps for applying the intermediate bonding layer 46 and the absorptive coating 40 to the inner surface 44 of the can portion 12A are given here. In one presently preferred embodiment, step 100 comprises initially rinsing the can portion with de-ionized water in a flushing operation lasting approximately five seconds. As may be seen by FIG. 5, this may be accomplished by injecting the de-ionized water through the fluid inlet 68A defined in the base plate 66, thereby continuously filling the inner volume 70 of the can portion 12A to a predetermined level indicated by the height "h." Step 100 serves as an initial cleaning step for the can portion 12A. As with the other solutions used in the current electroplating process, the de-ionized water may be stored until needed in holding tanks (not shown) that are in successive fluid communication with the fluid inlet 68. Once the rinsing operation of step 100 is complete, the de-ionized water is removed from the inner volume 70 via the fluid outlet 68B.

In step 110, the inner surface 44 to be plated is cleaned and chemically activated in preparation for receiving the intermediate bonding layer 46. To do this, step 110 includes continuously filling the inner volume 70 to the predetermined level "h" with a hydrochloric acid solution and circulating the solution approximately for 30 seconds, utilizing the weir-like function of the plating fixture 50 to maintain the level within the can portion 12A. This step not only further cleans the inner surface 44, but also prepares the inner surface to chemically interact with the electroplating solution that will be used to deposit the intermediate bonding layer 46. Thus, step 110 activates the inner surface 44, changing it from a chemically passive state to a chemically active state.

Once step 110 is complete and the hydrochloric acid solution has been drained from the inner volume 70, step 120 is performed, which includes a rinsing operation with de-ionized water for approximately 30 seconds, similar to the rinsing performed in step 100.

Step 130 includes the application of the intermediate bonding layer 46, preferably comprising nickel, to the inner surface 44 of the can portion 12A. In this step, a metallic solution containing nickel ions is continuously injected into the inner volume 70 and continuously circulated at constant level provided by the plating fixture 50. As already explained, the plating solution containing the nickel ions is injected into the inner volume 70 via the fluid inlet 68, during which time it rises to the desired height "h" corresponding to the top of the plating fixture 50. The nickel-containing plating solution, which may also be heated to a constant temperature, is circulated through the inner volume 70 not only via continuous solution input from the fluid inlet 68A, but also via the removal of excess electroplating solution over the first end 52 of the plating fixture 50 and ultimately through the fluid outlet defined by the second end 54 of the plating fixture. As mentioned further above, this continuous circulation of the electroplating solution ensures a uniform and stable application of the intermediate bonding layer 46 to the inner surface 44 as the electric current is supplied between the plating fixture 50 and the can portion 12A via the electroplating process. The nickel-containing electroplating solution is circulated within the inner volume 70 for approximately 20 seconds.

As a result of step 130, the intermediate bonding layer 46 is formed on the inner surface 44 of the can portion 12A, and comprises a nickel plate. The intermediate bonding layer 46 is chemically bonded via the electroplating process to the inner surface 44 of the can portion 12A such that an intermetallic bond is formed therebetween. In accordance with embodiments of the present invention, the intermediate bonding layer 46 desirably creates a preferred surface to which the absorptive coating 40 may be chemically bonded.

After completion of step 130, step 140 includes rinsing with de-ionized water within the inner volume 70 of the can portion 12A for approximately 30 seconds.

In step 150, the absorptive coating 40 is applied atop the intermediate bonding layer 46 in the can portion 12A. In presently preferred embodiments, the absorptive coating 40 comprises iron. In similar fashion to the process described in step 130 in connection with application of the intermediate bonding layer 46, absorptive coating 40 is applied atop the intermediate bonding layer. To do this, step 150 includes continuously filling the inner volume 70 with an electroplating solution containing iron to predetermined height "h" within the can portion 12A. This iron-containing plating solution, which may be heated to a constant temperature, is circulated through the can portion 12A in the same manner as described above, that is solution continuously entering the inner volume 70 through the inlet 68A while solution continuously exits the can portion 12A via the plating fixture 50 in a weir-like fashion. The absorptive coating 40 is formed upon the intermediate bonding layer 46 of the inner surface 44 as the electric current is supplied between the plating fixture 50 and the can portion. The iron-containing electroplating solution in step 150 is circulated within the inner volume 70 for of about 60 seconds before being removed therefrom. In this way, the absorptive coating 40 is formed within the can portion 12A, thereby creating a stable absorptive coating that will enable the can to dissipate heat in an enhanced manner during the operation of the x-ray tube 10.

Step 160 includes an intermediate rinse of the inner volume 70 of the can portion 12A with de-ionized water for a period of approximately 30 seconds.

In step 170, a final rinse of the inner volume 70 of the can portion 12A is performed with hot, de-ionized water sufficient to clean the coated inner surface 44.

In step 180, the can portion 12A is subjected to drying in a nitrogen environment. A further drying process is performed in step 190, wherein vacuum drying is employed to remove any residual moisture from the can portion 12A. The can portion 12A is then ready for joining to the second portion 12B and subsequent evacuation of any gases contained therein in order to form the complete evacuated enclosure 12. The evacuated enclosure 12 may then be incorporated into the x-ray tube 10.

It is appreciated that the above steps have been described in connection with one presently preferred embodiment disclosing a method for forming various coatings on the can portion 12A. However, it should be appreciated that variations to the above method may be employed while still residing within the present invention. For instance, the time of application, concentrations, and compositions of the various solutions used in the above method may be varied as to suit a particular application. Further, additional steps may be added to the present method to enhance the preparation of the can portion 12A, for instance, or to apply further coatings to the can portion 12A as may be appreciated by one skilled in the art.

In addition to the absorptive coating 40 and the intermediate bonding layer 46, other coatings may desirably be applied to the substrate 42 using the method described above in order to give the can portion 12A certain characteristics. Thus, such coatings having functions distinct from those explicitly described herein are also contemplated as comprising part of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In an x-ray generating device that includes an electron-producing cathode and an anode that receives electrons produced by the cathode, an x-ray tube component comprising:

an evacuated enclosure having a body portion comprised of a metallic substrate material, the body portion including an inner surface;

an intermediate bond coating bonded to at least a portion of the inner surface of the body portion; and an absorptive coating bonded atop at least a portion of the intermediate bond coating such that at least a portion of the absorptive coating is exposed to an evacuated environment of the evacuated enclosure.

2. An x-ray tube component as defined in claim 1, wherein the intermediate bond coating comprises nickel.

3. An x-ray tube component as defined in claim 1, wherein the absorptive coating comprises one of iron, chrome oxide, titanium and titanium dioxide.

4. An x-ray tube component as defined in claim 1, wherein the body portion comprises copper.

5. An x-ray tube component as defined in claim 1, wherein the intermediate bond coating is operable to increase the adhesion of the absorptive coating to the body portion.

6. An x-ray tube component as defined in claim 1, wherein the absorptive coating is operable to increase dissipation of heat from the evacuated enclosure during operation of the x-ray generating device.

7. An x-ray tube component as defined in claim 1, wherein the intermediate bond coating forms intermetallic bonds with both the metallic substrate material and the absorptive coating.

8. The x-ray tube component as recited in claim 1, wherein the evacuated enclosure is constructed substantially of a single piece of material.

9. The x-ray tube component as recited in claim 1, wherein the evacuated enclosure is constructed from a plurality of parts.

10. The x-ray tube component as recited in claim 9, wherein one of the plurality of parts substantially comprises one of glass and ceramic.

11. The x-ray tube component as recited in claim 1, wherein the absorptive coating has a coefficient of thermal expansion similar to both a coefficient of thermal expansion of the substrate material and to a coefficient of thermal expansion of the intermediate bond coating.

12. The x-ray tube component as recited in claim 1, wherein the absorptive coating has an intermetallic bonding affinity for the intermediate bond coating.

13. The x-ray tube component as recited in claim 1, wherein the intermediate bond coating has an intermetallic bonding affinity for the substrate material and for the absorptive coating.

14. An x-ray tube component used in an x-ray generating apparatus, the component comprising:

an evacuated enclosure having a first coating disposed along at least a portion of a surface of the evacuated enclosure, wherein the surface comprises a metallic substrate material;

a second coating disposed atop at least a portion of the first coating such that at least a portion of the second coating is exposed to an evacuated environment of the evacuated enclosure, and the second coating substantially comprising one of iron, chrome oxide, titanium and titanium dioxide; and wherein the first coating operates to increase the level of adhesion of the second coating to the surface of the evacuated enclosure.

15. The x-ray tube component as recited in claim 14, wherein the second coating has a coefficient of thermal expansion similar to both a coefficient of thermal expansion of the substrate material and to a coefficient of thermal expansion of the first coating.

16. The x-ray tube component as recited in claim 14, wherein the second coating has an intermetallic bonding affinity for the first coating.

17. The x-ray tube component as recited in claim 14, wherein the first coating has an intermetallic bonding affinity for the metallic substrate and for the second coating.

18. The x-ray tube component as recited in claim 14, wherein the x-ray tube component substantially comprises copper.

19. The x-ray tube component as recited in claim 14, wherein the first coating comprises nickel.

20. In an x-ray generating device that includes a cathode and an anode, an x-ray tube component comprising:

an evacuated enclosure having a body portion comprised substantially of copper, the body portion including an inner surface;

an absorptive layer comprised substantially of iron and that is disposed along at least a portion of the inner surface such that at least a portion of the absorptive layer is exposed to an evacuated environment of the evacuated enclosure, wherein the absorptive layer operates to increase dissipation of heat from the evacuated enclosure during operation of the x-ray generating device; and a bond layer comprised substantially of nickel, wherein the bond layer is disposed between the body portion and the absorptive layer.

* * * * *

UNITED STATES PATENT AND TRADEMARK OFFICE

CERTIFICATE OF CORRECTION

PATENT NO. : 7,209,546 B1
APPLICATION NO. : 10/122567
DATED : April 24, 2007
INVENTOR(S) : Arnold et al.

It is certified that error appears in the above-identified patent and that said Letters Patent is hereby corrected as shown below:

Column 11
Line 6, change "68" to --68A--

Column 12
Line 18, change "68" to --68A--

Signed and Sealed this

Seventh Day of December, 2010

David J. Kappos

David J. Kappos
*Director of the United States Patent and Trademark Office*